United States Patent [19]

Ried et al.

[11] 4,394,195

[45] Jul. 19, 1983

[54] COOLING OF CENTER PLATE TO AVOID SOFTENING

[75] Inventors: Harold T. Ried; Edgar C. Weaver, both of St. Charles, Mo.

[73] Assignee: ACF Industries, Incorporated, New York, N.Y.

[21] Appl. No.: 398,750

[22] Filed: Jul. 16, 1982

[51] Int. Cl.[3] ..... C21D 9/00

[52] U.S. Cl. ..... 148/149; 266/258; 432/226; 220/69; 220/429; 220/437; 62/DIG. 13; 148/148

[58] Field of Search ..... 148/149, 148, 145; 266/258; 62/DIG. 13; 432/226, 249; 220/429, 437, 69

[56] References Cited

U.S. PATENT DOCUMENTS

| | | | |
|---|---|---|---|
| 2,295,272 | 9/1942 | Somes | 148/145 |
| 2,619,439 | 11/1952 | Rennick | 148/149 |
| 3,558,367 | 1/1971 | Eck | 148/149 |
| 3,704,871 | 12/1972 | Paulson | 432/226 |
| 3,821,037 | 6/1974 | Snyder et al. | 148/148 |

*Primary Examiner*—L. Dewayne Rutledge
*Assistant Examiner*—R. McDowell
*Attorney, Agent, or Firm*—Henry W. Cummings

[57] ABSTRACT

In accordance with the invention, an insulating box (32) is applied to the depending portion (28) of the center plate (24) of a railway freight car. This box is provided with external insulation (27) and a cooling medium such as air or water is passed through a conduit (56) into the box to maintain the temperature of the hardened portion of the bowl sufficiently low that no transformation or softening takes place during stress relief. After stress relieving the box is removed and the cooling medium turned off. The hardness and strength of the center plate has not decreased sufficiently to require rehardening, and it is not necessary to rotate the car into another position to attach the center plate, or to reharden the center plate.

18 Claims, 10 Drawing Figures

COOLING OF CENTER PLATE TO AVOID SOFTENING

BACKGROUND OF THE INVENTION

In assembling a railway freight car such as a tank car which must be stress relieved, the stress relieving operation will soften parts previously hardened prior to the stress relief.

One such part is the center plate located between the car body and the supporting truck.

While it is possible to not apply the center plate until after stress relieving of the cars, this procedure requires turning the car over again after stress relief. This makes time of car production longer and more expensive.

SUMMARY OF THE INVENTION

In accordance with the invention, an insulating box is applied to the depending portion of the center plate. This box is provided with external insulation and a cooling medium such as air or water is passed through the box to maintain the temperature of the hardened portion of the bowl sufficiently low that transformation and/or softening which normally takes place during stress relief is substantially reduced or eliminated.

After stress relieving the box is removed and the cooling medium turned off.

It therefore is not necessary to remove the center plate prior to stress relief or rotate the car into another position to reattach the center plate, or to reharden the center plate.

IN THE DRAWINGS

Figure 5:
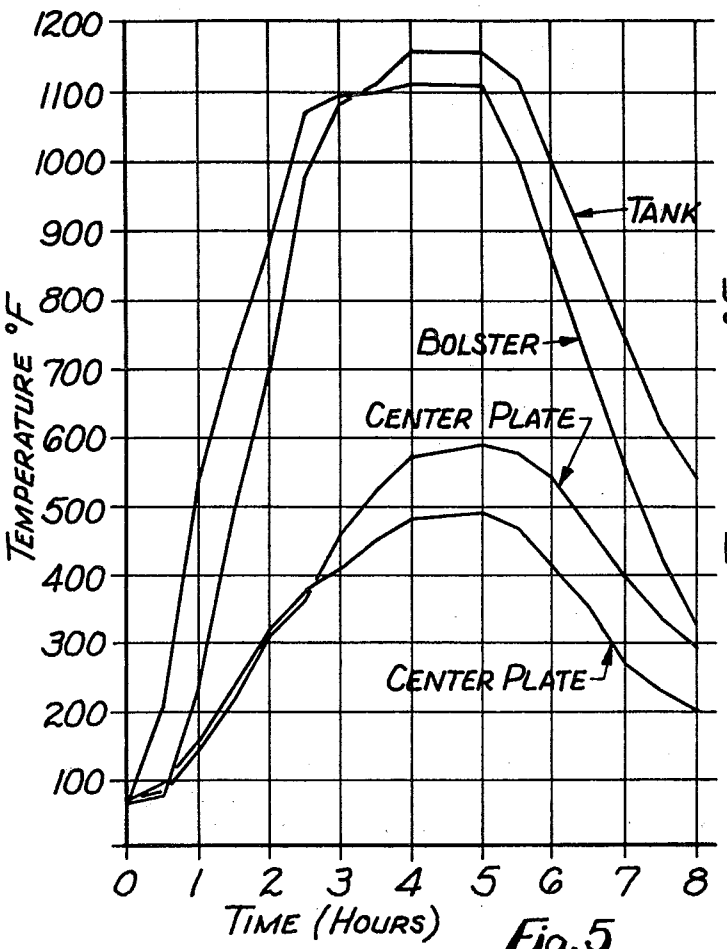

FIG. 5 is a plot of the test carried out in Example II. Two termocouples were attached to the center plate, and their readings are plotted. Also the temperature of the tank body and the bolster temperature are plotted.

Figure 6:
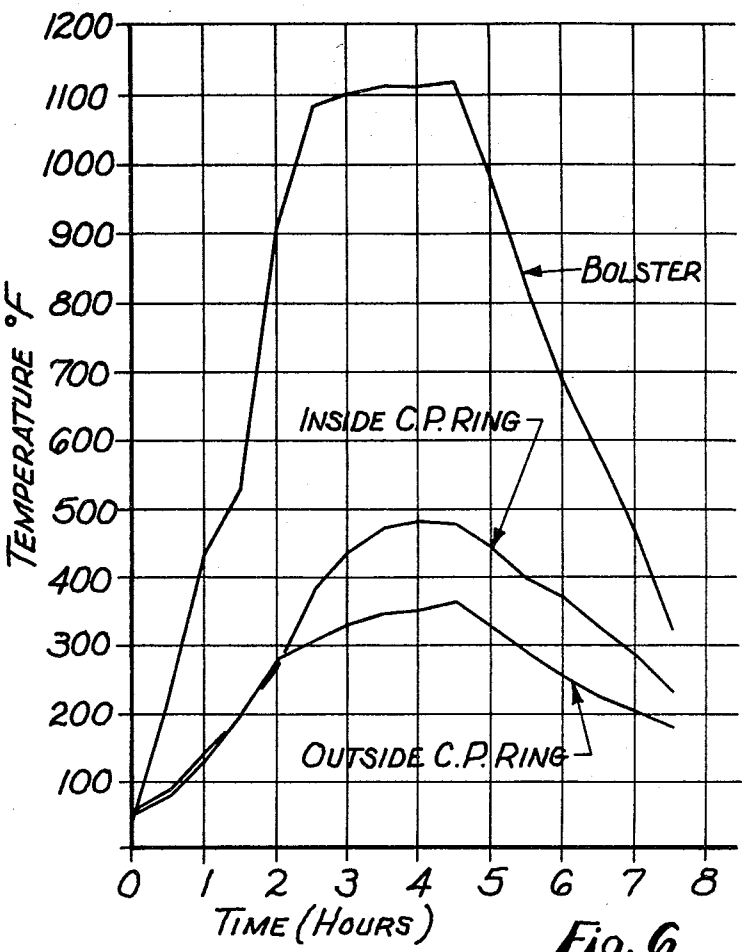

FIG. 6 is a plot of Example III, and illustrates the difference in temperature between thermocouples located inside the center plate ring and thermocouples located outside the center plate ring.

Figure 7:
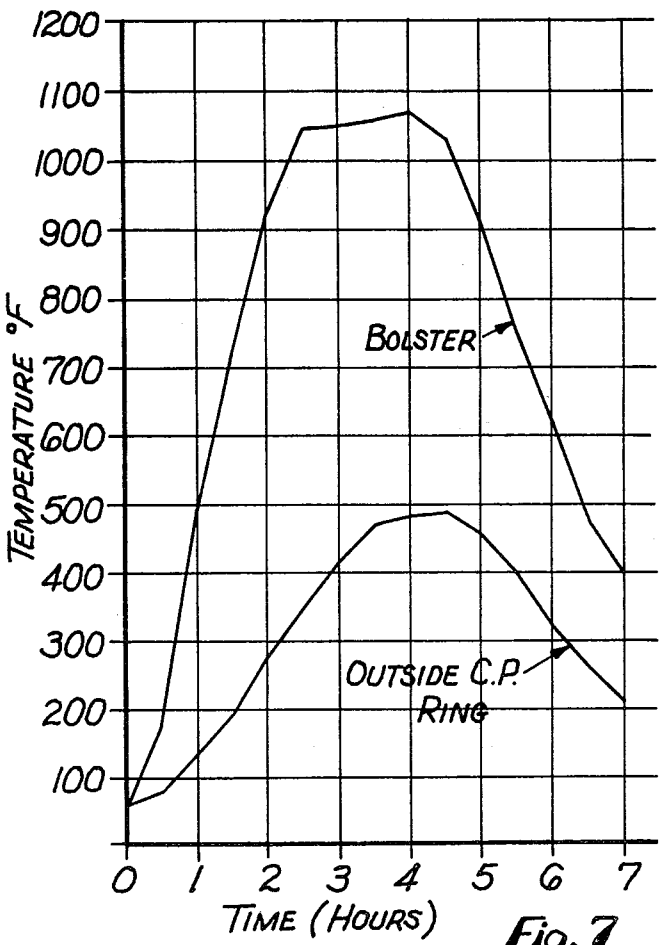

FIG. 7 is a plot of Example IV. One thermocouple was located on the inside of the center plate and the other one was connected to the bolster.

Figure 8:
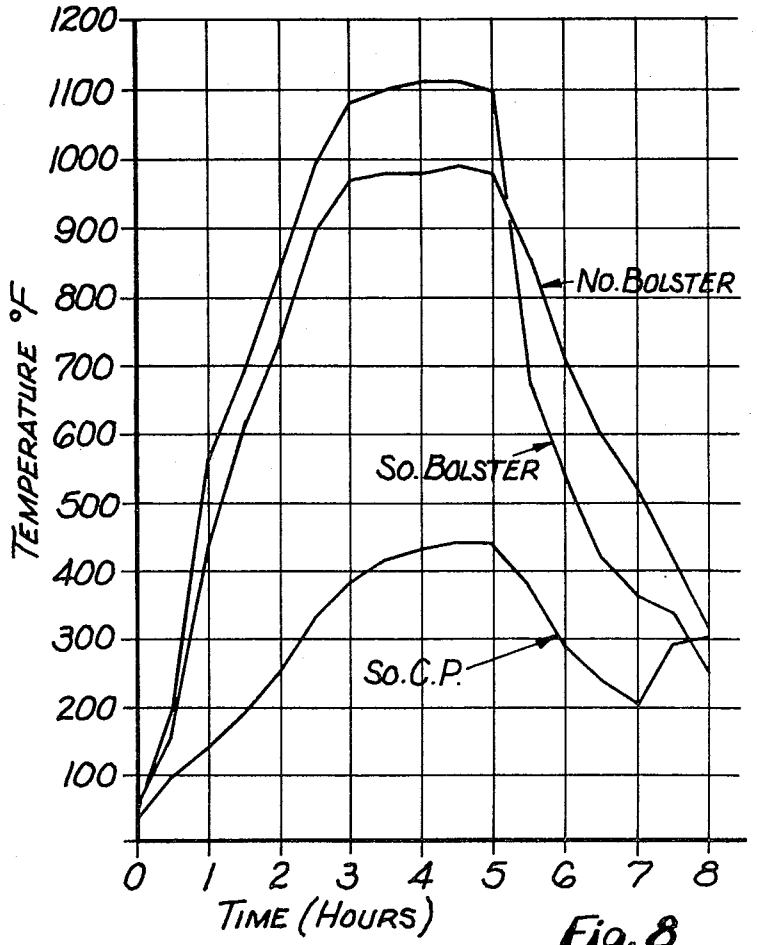

FIG. 8 is a plot of Example V. Four thermocouples were initially used. One on the south center plate and the north center plate, and one on the south bolster above the south center plate, and another on the north bolster above the north center plate. However, the north center plate thermocouple malfunctioned. Therefore, its readings are not plotted in FIG. 8.

Figure 9:
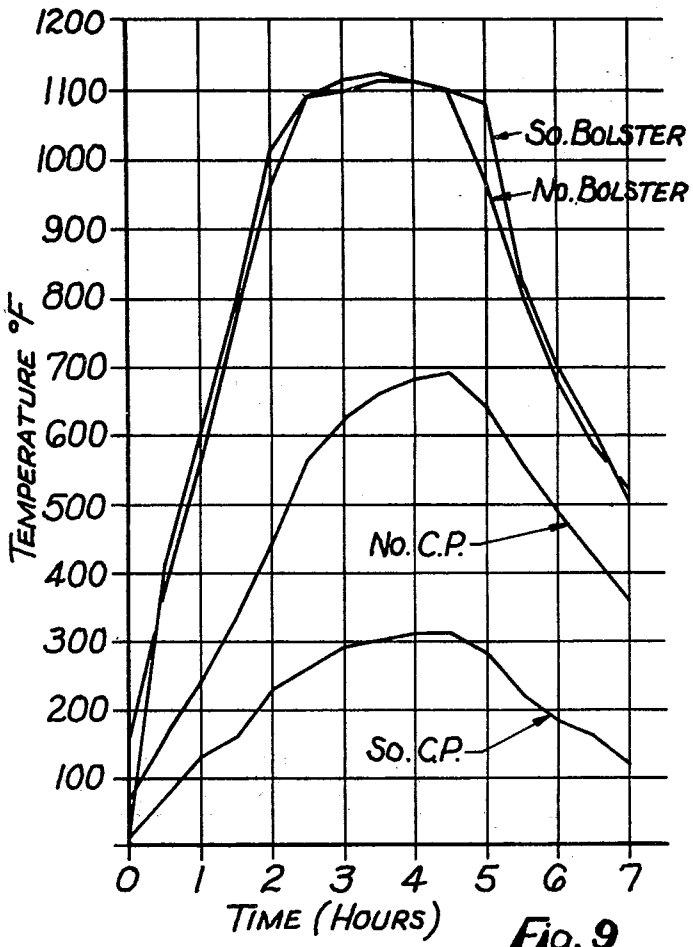

FIG. 9 is a plot of Example VI. Example VI was conducted in the same manner as Example V, except a different car was used. In this case, the thermocouple on the north center plate did not malfunction, and its readings are plotted.

Figure 10:
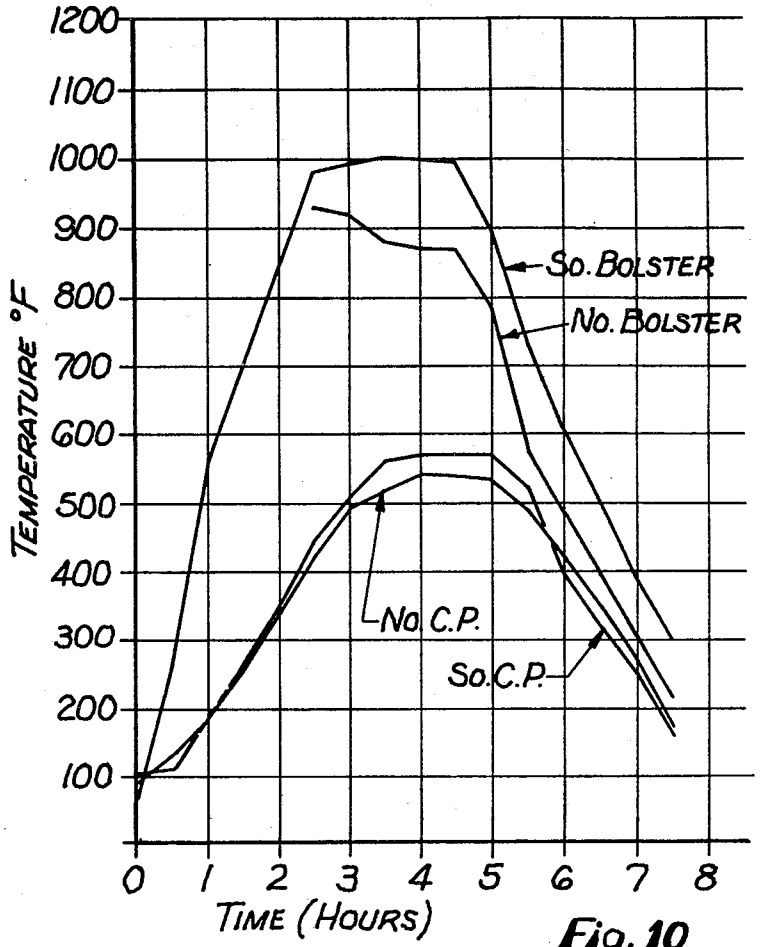

FIG. 10 is a plot of Example VII. This was conducted in the same manner as Example VI, except that two layers of Kaowool insulation were applied to the pipe supplying air to the north insulation box instead of one layer. The north center plate temperature is significantly reduced over that obtained in Example VI, FIG. 9, wherein only one layer of Kaowool insulation was used.

DESCRIPTION OF PREFERRED EMBODIMENTS

In the drawings, a railway tank car 10 includes a tank body 12 having depending therefrom a tank car bolster 14 at both ends of the car. The bolster 14 includes laterally spaced transversely extending vertical plates 16 and 18, and a bolster bottom cover plate 19. Plates 16 and 18 are respectively separated by vertical legs 20 and 22. In the transverse center portion of the car a center plate assembly is provided as indicated at 24. This center plate assembly includes a stub sill 26 into which is welded a center plate member 28 which depends from the car body, and which rests in a railway car truck bowl (not shown) when the car body and truck are assembled.

Figure 2:
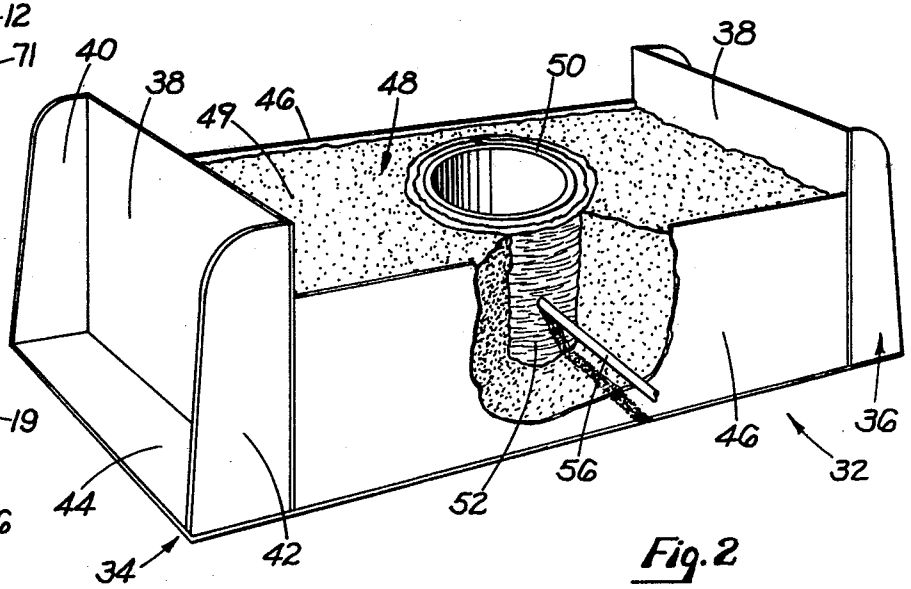
FIG. 2 is a perspective view of an insulating box to be utilized in the apparatus shown in FIG. 1.
Figure 1:
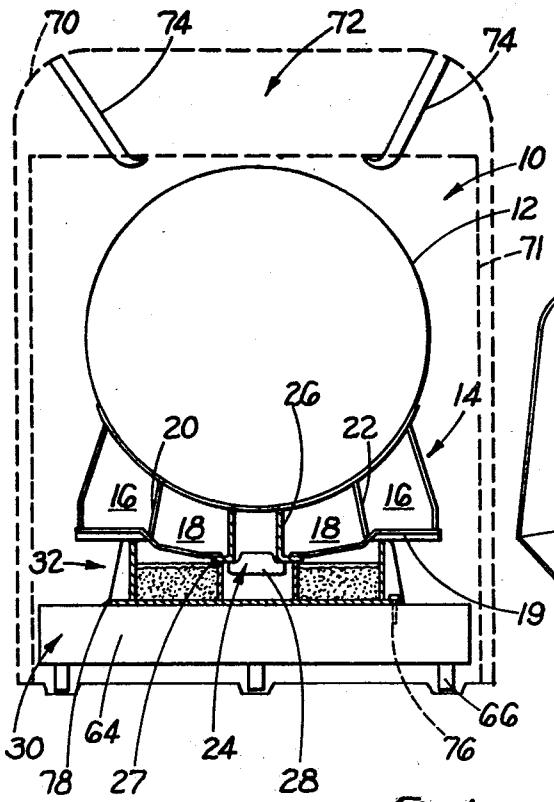
FIG. 1 is a schematic vertical sectional view of the heat treating apparatus of the present invention.

An insulating and cooling assembly 30 is provided to prevent the center plate from softening during stress relief. This assembly comprises an insulating box indicated at 32. As shown in FIG. 2, this insulating box 32 comprises a pair of end members 34 and 36. Each end member includes an end wall 38 and a pair of outwardly extending gussets 40 and 42. A bottom plate 44 joins the gussets 40 and 42 and the end wall 38, and extends the full length of the box. The insulating box further includes a pair of side walls 46 thereby defining with the end walls 38 and bottom 40 a rectangular open area 48.

In the midportion of the opening 48, a steel cylinder 50 is inserted. The steel cylinder is adapted to receive the center plate. At least one layer of insulation 52 is wrapped around the steel cylinder. Preferably a pair of such insulating layers are wound about the steel cylinder. An example of suitable insulating material is sold under the trade name Kaowool. Insulating material such as sand 49 is located in the space 48 in the box.

Figure 3:
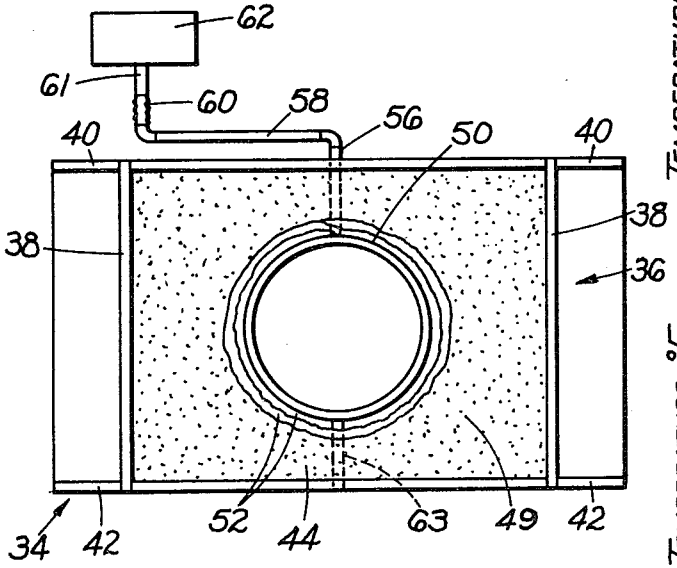
FIG. 3 is a plan view of the box with the tank car removed illustrating the cooling medium inlet and outlet.

As shown in FIG. 3, a conduit 56 is connected to the vertical midportion of the cylinder 50. This conduit extends outwardly at right angles to the box, and then makes a 90° bend and extends longitudinally of the box as indicated at 58. At the end of the pipe section 58, a connection 60 is provided to connect the pipe to a source of cooling medium indicated at 62. Such a cooling medium may comprise compressed air, water, gas or other liquid medium. A cooling medium exit pipe or conduit is provided at 63.

The insulating box 32 is located upon a furnace car 64 having wheels 66 used to move the tank bodies into a stress relief furnace indicated generally at 70. Means for heating the car to affect stress relief are indicated generally at 72, in this case comprising a series of gas burners 74. The insulating box may merely rest on the furnace car or be connected to the furnace car with mechanical fasteners 76 or by welding as indicated at 78. Outwardly extending flanges 27 of the center sill are supported by the steel cylinder 50. The bolster bottom cover plate 19 rests upon end members 34 and 36 supported by gussets 40 and 42.

The steel cylinder 50 is welded to the bottom plate 44 to obtain a rugged construction because the cylinder walls must carry a portion of the load of the tank body down into the support plate and furnace car.

In the operation of the invention, the tank car with its depending bolster portion 14 and the center plate 24 is lifted by an overhead crane and is lowered into position upon an assembly of the furnace car 64 with the insulating box 32 located thereon. The hardened center plate 24 extends into the steel cylinder 52. The furnace car is then pushed into the stress relief furnace 70, and furnace door 71 is closed. A quick connect fitting 61 connects a source of cooling fluid from source 62 into the conduit 60. Cooling medium is then forced through conduit 56 into the cylinder 50 to cool the depending center plate portion 24 and exits through conduit 63.

In the stress relief furnace the tank body 12 and the bolster 14 are stress relieved by heating commonly to temperatures in excess of 1,100° F. with burners 72. By contrast, with the cooling arrangement of the present invention, the center plate commonly remains at a temperature below about 600° F. If the temperature is maintained below about 600° F., only a minimal amount of softening occurs of the center plate.

EXAMPLE I (A) The first in a series of tests was conducted to determine a feasible method of protecting center plates 24 through the stress relief furnace 70. This test used an insulation box 32 to protect the center plate 24. The insulation box was modified to provide air flow over the center plate surface for cooling. Shop air was supplied through a 1¼" pipe 56 and exhausted into the furnace. An unprotected center plate was attached to the opposite end of the car to see how it would be affected by the full stress relief process.

(B) Prior to the Test:

1. The Brinell hardness was checked on 24 riveted center plates. This was done so we would know how much actual change in hardness occurred during the test. (See Data Sheet #2)
2. Thermocouples were attached to each center plate (both the unprotected and the protected) so the temperatures of each could be monitored throughout the test.
3. The insulation box was set on one end of the car only. The center plate on the other end was unprotected.
4. Regular center plates were used. The center plates were bolted on with 4 bolts so they could be removed easily after the test.

(C) During the Test:

Once the tanks 10 were loaded on the furnace bed 20 and moved into the furnace, thermocouples were hooked up to monitor temperatures. The air supply was not hooked up until after purge because the door had to be open throughout the purge cycle. Once the purge was complete, the door was shut and the air turned on.

(D) The temperature of the two center plates were recorded on the 24 point recorder in the Furance Room. The air was left on throughout the furnace cycle. The only time it was unhooked was for about 1 minute when the door was opened during the cool down period. After that the air was left on until the tank cooled down to 300° F.

(E) After the Test:

The center plates were removed and the hardness was checked. The results were as follows:

| | Before Furnace | After Furnace |
|---|---|---|
| Protected center plate | 601 Brinell | 555 Brinell |
| | 555 Brinell | 461 Brinell |
| Unprotected center plate | 601 Brinell | 241 Brinell |
| | 601 Brinell | 269 Brinell |

Figure 4:
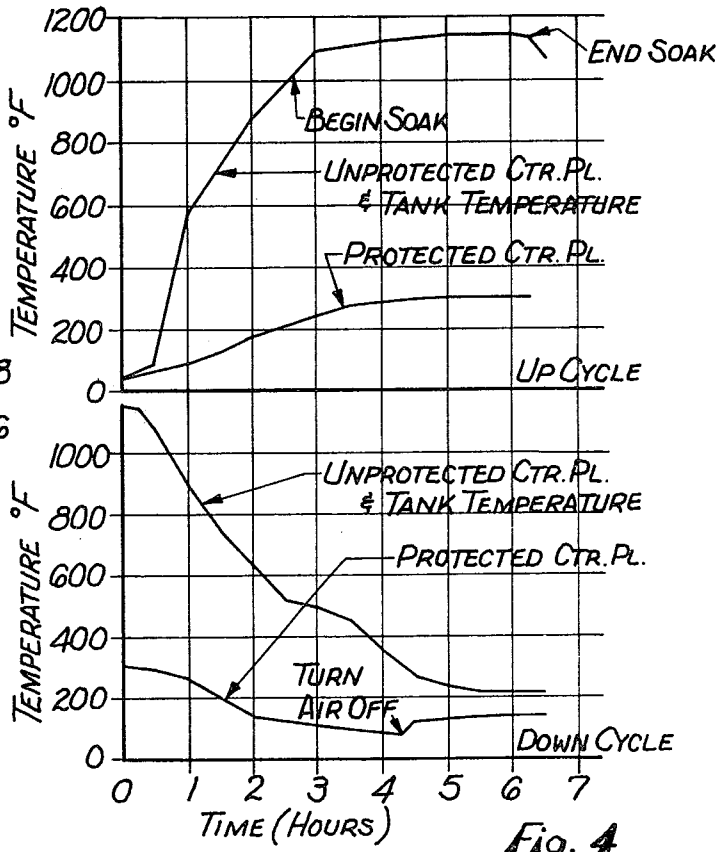
FIG. 4 is a plot of center plate temperature against time of heating while the center plates were heated up and center plate temperature while the center plates were permitted to cool. The temperature of an unprotected center plate and a protected center plate is plotted.

FIG. 4 shows the monitored temperatures of both center plates throughout the furnace cycle.

EXAMPLE II

The second center plate test was conducted. This test was conducted the same as the first one, but there was not an unprotected center plate attached to the tank this time. Also, two thermocouples were hooked up on the outside ring of the center plate. A third thermocouple was hooked onto the bolster near the air exiting from the insulation box. This was placed to detect any difference in temperature on the tank resulting from the discharged air. This reading showed that the temperature difference was negligible. A fourth thermocouple was hooked up inside the tank, on the side.

After the Test:

The center plate was removed and the hardness was checked. The results are as follows:

| | Before Furnace | After Furnace |
|---|---|---|
| Center plate | 555 | 415 |
| | 555 | 415 |

The high temperatures which were recorded are as follows:

| | | | |
|---|---|---|---|
| Inside Tank | 1155° F. | Center Plate | 590° F. |
| Bolster | 1115° F. | Center Plate | 490° F. |

FIG. 5 shows the monitored temperatures of the center plate, bolster and tank throughout the furnace cycle.

The temperature increase from the first test to the second test was due to insulation being blown into the exit vents on the insulation box. This prevented air from circulating in the box and over the center plate.

EXAMPLE III

This test was conducted the same as the first two, except one thermocouple was placed on the outside of the center plate ring and a second thermocouple was placed on the inside of the center plate. The third thermocouple was placed on the bolster. Again no negligible temperature difference was noticed at the bolster due to the discharged air.

After the Test:

The center plate was removed and the hardness was checked. The results are as follows:

| | Before Furnace | After Furnace |
|---|---|---|
| Center Plate | 601 | 477 |
| | 601 | 477 |

The high temperatures which were recorded are as follows:

| | |
|---|---|
| Bolster | 1115° F. |
| Inside Center Plate | 485° F. |
| Outside Center Plate | 360° F. |

FIG. 6 shows the monitored temperature of the center plate and bolster throughout the furnace cycle.

EXAMPLE IV

This test differed from the first three. The second insulation box was modified to allow in and out piping in the box. The box was also changed to allow the center plate to fit flat on the insulation box, thus allowing no air flow along the sides of the center plate. The air now goes into the insulation box through the lower hole in the box and exits through the top hole. This approach was taken because there was concern that the air discharging into the furnace would not allow the tank to heat to the desired temperature for stress relief. Two thermocouples were hooked up. One was put on the inside of the center plate while the other one was hooked up on the bolster.

After the Test:

The center plate was removed and the hardness was checked. The results are as follows:

| | Before Furnace | After Furnace |
|---|---|---|
| Center Plate | 601 | 444 |
| | 601 | 477 |

The high temperatures which were recorded are as follows:

| | | | |
|---|---|---|---|
| Bolster | 1080° F. | Outside Center Plate | 490° F. |

FIG. 7 shows the monitored temperatures of the center plate and bolster throughout the furnace cycle. This test proved that the discharged air in the furnace had no effect on lowering the temperature of the car.

EXAMPLE V

This test was run on four 23,500 gallon tanks having low profile welded center plates. This was our first test on supplying air to two boxes, and also our first attempt at trying to cool a center plate, which is farther into the furnace bed. We did not change our boxes from the previous tests. We had one box with the in and out piping system and one box with air flow out the sides of the box. We had not conducted any tests running two boxes off of one air supply so we ran a separate air supply for each box. One box was piped using 55 feet of 1¼" I.D. carbon steel piping. This pipe was wrapped, using Kaowool, over the entire length because it was exposed to direct heat from the gas jets of the furnace. The box used on this end was the box which disperses the air from the sides. There were four thermocouples applied; two were placed on the center plates and two were applied to the bolster directly outside of the center plate area. Car #3 of the 422 lot was one used for this test.

After the Test:

The center plates were tested using a portable hardness test. The results are as follows:

| | Before Furnace | After Furnace |
|---|---|---|
| A End Center Plate | 415* | 455–477–482 Brinell |
| B End Center Plate | 444 | 425 |

*The Brinell hardness reading before furnace on the A End Center Plate is questionable. We took three separate hardness readings after furnace and they were all about the same. Possibly the before furnace hardness was taken in an area that did not receive the same amount of flame hardening as the rest of the plate. The north bolster temperature reading was not as high as previous ones. This could be caused by the condition of thermocouple wire. It was frayed in a few places. The north center plate reading malfunctioned because it was spliced and the reading recorded was the one taken at the splice on the furnace bed and not the one recorded at the center plate.

The high temperatures which were recorded are as follows:

| | | | |
|---|---|---|---|
| North Bolster | 990° F. | South Bolster | 1120° F. |
| North Center Plate | Malfunction | South Center Plate | 445° F. |

FIG. 8 shows the monitored temperatures of the center plate and bolster throughout the furnace cycle.

EXAMPLE IV

Test #6 was conducted on Car #4. This test was run the same as the previous one.

After the Test:

The center plates were tested using a portable hardness test. The results are as follows:

| | Before Furnace | After Furnace |
|---|---|---|
| South or B End Center Plate | 429 Brinell | 407 |
| North or A End Center Plate | 444 Brinell | 350 |

The high temperatures which were recorded are as follows:

| | | | |
|---|---|---|---|
| North Bolster | 1120° F. | South Bolster | 1115° F. |
| North Center Plate | 315° F. | South Center Plate | 690° F.* |

*Unexplained reason for the high temperature.

FIG. 9 shows the monitored temperatures of both the bolsters and center plates throughout the furnace cycle.

The bolster thermocouples were placed where the bolster adjoins the tank. They have been placed on the bottom of the bolster right outside of the center plate box before. They were placed at the seam between the bolster and tank now, because that is more critical to stress relieve the tank than the bolster. The readings on the bolster showed that there is no substantial drop in heat in the area being cooled.

EXAMPLE VII

Test #7 was conducted on Car #2. This test was run the same as the previous two except the pipe supplying air to the north insulation box was wrapped with two layers of Kaowool instead of one.

After the Test:

The center plates were tested using a partable hardness test. The results are as follows:

| | Before Furnace | After Furnace |
|---|---|---|
| B End Center Plate | 388 | 375 |
| A End Center Plate | 444 | 410 |

The high temperatures which were recorded are as follows:

| | | | |
|---|---|---|---|
| North Bolster | 930° F. | South Bolster | 1000° F. |
| North Center Plate | 540° F. | South Center Plate | 575° F. |

FIG. 10 shows the monitored temperatures of the center plates and bolsters throughout the furnace cycle.

The temperature of the center plates was higher for this test than the previous ones. The insulation boxes were not removed from the furnace bed since the last test and were used as cants for the other furnace heats. This did not allow the box to cool and the starting temperature was higher, thus the plates got hotter during the furnace. The center plates still were above minimum hardness so no problem is foreseen due to continued use of the boxes.

EXAMPLE VIII

Test #8 was conducted on Car #1. This test was run the same as the other tests except the thermocouples placed on the car malfunctioned, so no accurate temperature readings were recorded. The hardness was checked and the results are as follows:

After the Test:

The center plates were tested using a portable hardness test.

| | Before Furnace | After Furnace |
|---|---|---|
| South or B End Center Plate | 444 | 443 |
| North or A End Center Plate | 555 | 404 |

EXAMPLE IX

A car was furnaced with riveted center plates. No hardness readings were taken before the furnace. These center plates were insulated but no thermocouples were hooked up. The center plate hardness was checked after the furnace, using the portable hardness machine. The results are as follows:

| | After Furnace |
|---|---|
| North or A End Center Plate | 363 |
| South or B End Center Plate | 495 |

CONCLUSIONS

The tests results as seen on Data Sheet #1 vary.

No definite relationship can be seen between the temperature of the center plate and the decrease in hardness, through an unprotected center plate fell below the minimum hardness reading required by Association of American Railroads (AAR).

Thus some form of insulating of plates is required.

Irregularities in the hardness readings is due to many reasons such as: the accuracy of testing; the amount of pressure put on the striking bar is never the same in a portable test; the hardness from spot to spot on the center plate varies due to differences in heat quenching.

The air flow into the box and alongside the tank proved to have little affect on lowering the temperature of the tank in that area, when the insulating box and cooling was used instead, except Example VI.

The results did show that in none of our tests was the hardness below that required by AAR. Hence the insulation boxes were adequate to protect the center plates.

All center plates can now be put on prior to furnace by either riveting or welding and the technique of the present invention used to prevent substantial softening of the center plate.

DATA SHEET No. 1

| Test No. | Brinell Hardness Before Furnace | Brinell Hardness After Furnace | Maximum Temperature Bolster | Tank | C.P. |
|---|---|---|---|---|---|
| 1 | Protected 601-555 | 555-461 | | 1140° | 300° |
| | Unprotected 601—601 | 241-269 | | 1140° | 1140° |
| 2 | 555—555 | 415—415 | 1115° | 1155° | 590° |
| 3 | 601—601 | 477—477 | 1115° | 1140° | 485° |
| 4 | 601—601 | 444-477 | 1080° | 1140° | 490° |
| 5 | A End 415 | 455-477-482 | 990° | 1140° | |
| | B End 444 | 425 | 1120° | 1140° | 445° |
| 6 | A End 444 | 350 | 1120° | 1140° | 315° |
| | B End 429 | 429 | 1115° | 1140° | 690°* |
| 7 | A End 444 | 410 | | 1140° | 540° |
| | B End 388 | 375 | | 1140° | 575° |
| 8 | A End 555 | 404 | | | |
| | B End 444 | 443 | | | |

*Unexplained reason for high temperature.

DATA SHEET #2
RIVETED CENTER PLATES
BRINELL HARDNESS READINGS

| CENTER PLATE | BRINELL HARDNESS READINGS Before Furnace | After Furnace |
|---|---|---|
| 1 | 601-555 | |
| 2 | 601-653 | |
| 3 | 578-601 | |
| 4 | 601-555 | |
| 5 | 555-601 | |
| 6 | 601—601 | |
| 7 | 601-555 | |
| 8 | 555—555 | 415—415 |
| 9 | 555-601 | |
| 10 | 555—555 | |
| 11 | 601-555 | |
| 12 | 601—601 | 477—477 |
| 13 | 601-555 | |
| 14 | 601-555 | |
| 15 | 601-555 | |
| 16 | 555-601 | |
| 17 | 601-555 | |
| 18 | 601-555 | |
| 19 | 601—601 | 444-477 |
| 20 | 601—601 | |
| 21 | 555-601 | |
| 22 | 601—601 | |
| 23 | 601-555 | 555-461 |
| 24 | 601—601 | 241-249 Unprotected |

What is claimed is:

1. Apparatus for heat treating a railway car body while maintaining a portion thereof unheat treated comprising: a heat treat furnace having means for heating a railway car body; movable support means for moving the railway car body into the heat treating furnace; an insulating box located on said support means; said insulating box including end support means for supporting a portion of said railway car body and center support means for supporting at least a portion of the railway car body; an opening within said insulating box adapted to receive a portion of said railway car body which is not to be heat treated; insulating means surrounding said center car support means; means for introducing a cooling medium into said center support means whereby said cooling medium maintains said car body depending portion at a sufficiently low temperature to avoid substantial softening of the depending portion and whereby said heat treating furnace heat treats the remaining portion of said car to a desired heat treating temperature.

2. Apparatus according to claim 1, wherein said depending member is a railway car center plate and wherein said depending member extends within a hollow portion of said insulating box.

3. Apparatus according to claim 1, wherein means are provided for exiting said cooling medium from said box.

4. Apparatus according to claim 2, wherein said hollow portion supports a portion of a center sill located upon said railway car and wherein said end supports support a portion of a depending bolster located upon said railway car.

5. Apparatus according to claim 2, wherein a plurality of walls define a void space surrounding said hollow portion and said hollow portion is filled with a second insulating material outboard of said first insulating material.

6. Apparatus according to claim 5, wherein said first insulating material is Kaowool and said second insulating material is sand.

7. Apparatus according to claim 1, wherein said cooling medium is gas.

8. Apparatus according to claim 1, wherein said cooling media is a liquid.

9. Apparatus according to claim 7, wherein said gaseous cooling media is air.

10. Apparatus according to claim 9, wherein said liquid cooling media is water.

11. Apparatus according to claim 1, wherein said insulating box comprises a pair of transversely extending walls each of which joins said end walls and wherein said side walls join a bottom plate extending transversely of the car.

12. Apparatus according to claim 11, wherein said end supports include a pair of outwardly extending gussets connected to said end plates and to said bottom plate.

13. A method of heat treating a railway freight car body while maintaining a selected portion in an unsoftened state comprising: locating an insulating box adapted to receive a depending portion of a railway car which is not to be softened upon a movable support member; providing insulating adjacent said depending portion to prevent heat from a heat treating furnace from softening said depending member; circulating a cooling medium into the area where said depending member is located while heat treating the railway freight car body and removing the railway freight car from the heat treating furnace and disconnecting the flow of said cooling media into said insulating material.

14. A method according to claim 13, wherein said depending portion extends into a hollow metallic portion and wherein a first insulating material surrounds said metallic portion and a second insulating material is located outboard of said first insulating material.

15. A method according to claim 14, wherein said first insulating material is Kaowool and said second insulating material is sand.

16. A method according to claim 15, wherein said cooling media is a gas.

17. A method according to claim 16, wherein the cooling media is a liquid.

18. A method according to claim 13, wherein an insulating box supports an outwardly extending bolster portion of said car and said metallic portion supports a center sill portion of said car during heat treating.

* * * * *